US006951383B2

(12) United States Patent
Giere et al.

(10) Patent No.: US 6,951,383 B2
(45) Date of Patent: Oct. 4, 2005

(54) FLUID EJECTION DEVICE HAVING A SUBSTRATE TO FILTER FLUID AND METHOD OF MANUFACTURE

(75) Inventors: Matthew Giere, San Diego, CA (US); Antonio S. Cruz-Uribe, Corvallis, OR (US); Jeffery Hess, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 171 days.

(21) Appl. No.: 10/600,736

(22) Filed: Jun. 20, 2003

(65) Prior Publication Data

US 2004/0036751 A1 Feb. 26, 2004

Related U.S. Application Data

(63) Continuation-in-part of application No. 10/115,294, filed on Apr. 3, 2002, now Pat. No. 6,582,064, which is a continuation of application No. 09/597,018, filed on Jun. 20, 2000, now abandoned.

(51) Int. Cl.[7] ..... B41J 2/05
(52) U.S. Cl. ..... 347/56
(58) Field of Search ..... 347/56, 63, 64, 347/61, 62, 65, 67, 84, 85, 86, 1, 7, 5, 9, 20

(56) References Cited

U.S. PATENT DOCUMENTS

| | | | | |
|---|---|---|---|---|
| 4,683,481 | A | 7/1987 | Johnson | |
| 4,931,811 | A | 6/1990 | Cowger et al. | |
| 5,409,134 | A | 4/1995 | Cowger et al. | |
| 5,489,930 | A | 2/1996 | Anderson | |
| 5,659,345 | A | 8/1997 | Altendorf | |
| 6,000,787 | A | 12/1999 | Weber et al. | |
| 6,084,618 | A | 7/2000 | Baker | |
| 6,260,957 | B1 | 7/2001 | Corley, Jr. et al. | |
| 6,264,309 | B1 | 7/2001 | Sullivan | |
| 6,305,080 | B1 | 10/2001 | Komuro et al. | |
| 6,305,790 | B1 | 10/2001 | Kawamura et al. | |
| 6,309,054 | B1 | 10/2001 | Kawamura et al. | |
| 6,394,580 | B1 | 5/2002 | Scheffelin et al. | |
| 2003/0016270 | A1 * | 1/2003 | Kubota et al. | 347/47 |
| 2004/0104198 | A1 * | 6/2004 | Chen et al. | 216/27 |

* cited by examiner

*Primary Examiner*—Raquel Y. Gordon

(57) ABSTRACT

A fluid ejection device is described. One exemplary embodiment includes a substrate having a first surface and a second surface, the substrate defines a fluid supply conduit between the first surface and the second surface. This particular fluid ejecting device also includes a generally elastic filter layer formed over the first surface where the filter layer does not form sidewalls defining a fluid channel of the fluid ejection device.

23 Claims, 15 Drawing Sheets

FLUID EJECTION DEVICE HAVING A SUBSTRATE TO FILTER FLUID AND METHOD OF MANUFACTURE

This application is a continuation-in-part and claims priority from a U.S. patent application having Ser. No. 10/115,294, filed on Apr. 3, 2002 now U.S. Pat. No. 6,582,064, which is a continuation of and claims priority from a U.S. patent application having Ser. No. 09/597,018 filed on Jun. 20, 2000 now abandoned.

BACKGROUND OF THE INVENTION

Throughout the business world, thermal ink jet printing systems are extensively used for image reproduction. Ink jet printing systems use cartridges that shoot droplets of colorant onto a printable surface to generate an image. Such systems may be used in a wide variety of applications, including computer printers, plotters, copiers and facsimile machines. For convenience, the concepts of the invention are discussed in the context of thermal ink jet printers. Thermal ink jet printers typically employ one or more cartridges that are mounted on a carriage that traverses back and forth across the width of a piece of paper or other medium feeding through the ink jet printer.

Each ink jet cartridge includes an ink reservoir, such as a capillary storage member containing ink, that supplies ink to the printhead of the cartridge through a standpipe. The printhead includes an array of firing chambers having orifices (also called nozzles) which face the paper. The ink is applied to individually addressable ink energizing elements (such as firing resistors) within the firing chambers. Energy heats the ink within the firing chambers causing the ink to bubble. This in turn causes the ink to be expelled out of the orifice of the firing chamber toward the paper. As the ink is expelled, the bubble collapses and more ink is drawn into the firing chambers from the capillary storage member, allowing for repetition of the ink expulsion process.

To obtain print quality and speed, it is necessary to maximize the density of the firing chambers and/or increase the number of nozzles. Maximizing the density of the firing chambers and/or increasing the number of nozzles typically necessitates an increase in the size of the printhead and/or a miniaturization of printhead components. When the density is sufficiently high, conventional manufacturing by assembling separately produced components becomes prohibitive. The substrate that supports firing resistors, the barrier that isolates individual resistors, and the orifice layer that provides a nozzle above each resistor are all subject to small dimensional variations that can accumulate to limit miniaturization. In addition, the assembly of such components for conventional printheads requires precision that limits manufacturing efficiency.

Printheads have been developed using in part manufacturing processes that employ photolithographic techniques similar to those used in semiconductor manufacturing. The components are constructed on a flat wafer by selectively adding and subtracting layers of various materials using these photolithographic techniques. Some existing printheads are manufactured by printing a mandrel layer of sacrificial material where firing chambers and ink conduits are desired, covering the mandrel with a shell material, then etching or dissolving the mandrel to provide a chamber defined by the shell.

In print cartridges typically used in thermal ink jet printers, a filter element is generally placed at the inlet of the standpipe against the ink reservoir (i.e., capillary storage member). The filter element acts as a conduit for ink to the inlet of the standpipe and prevents drying of ink in the capillary storage member adjacent the inlet of the standpipe. In addition, the filter element precludes debris and air bubbles from passing from the ink reservoir into the standpipe and therefrom into the printhead. Without a filter element, debris and/or air bubbles could enter the printhead and cause clogging of the ink flow channels, conduits, chambers and orifices within the printhead. This clogging is likely to result in one or more inoperable firing chambers within the printhead, which would require that the ink jet print cartridge, with the clogged printhead, be replaced with a new ink jet cartridge before the ink in the clogged cartridge is exhausted. From the perspective of cost, this course of action is undesirable.

The filter element within the ink jet print cartridge also helps to prevent pressure surges and spike surges of ink from the ink reservoir to the standpipe. A pressure surge of ink occurs upon oscillation of the print cartridge during movement of the carriage of the printer. A pressure surge can cause ink to puddle within the orifices of the firing chambers. This puddled ink can dry up clogging the firing chambers. A spike surge of ink occurs when the ink jet cartridge is jarred or dropped. In a spike surge, ink is rapidly displaced within the ink jet cartridge, which could allow air to be gulped into the firing chambers of the printhead, causing these chambers to de-prime. In these instances, the filter element, because it restricts ink fluid flow, helps to prevent unwanted puddling of ink within the nozzles and/or depriming of the firing chambers. However, since the filter element is rigid and positioned at the inlet of the standpipe, the filter element is somewhat ineffective for preventing pressure surges and spike surges for the ink within the standpipe itself.

BRIEF DESCRIPTION OF THE DRAWINGS

The accompanying drawings are incorporated in and constitute a part of this specification. The drawings illustrate embodiments of the present invention. In the accompanying drawings like reference numerals designate like parts wherever possible.

FIG. 7E' illustrates a top view of a patterned layer shown in FIG. 7E.

DETAILED DESCRIPTION

Figure 1:
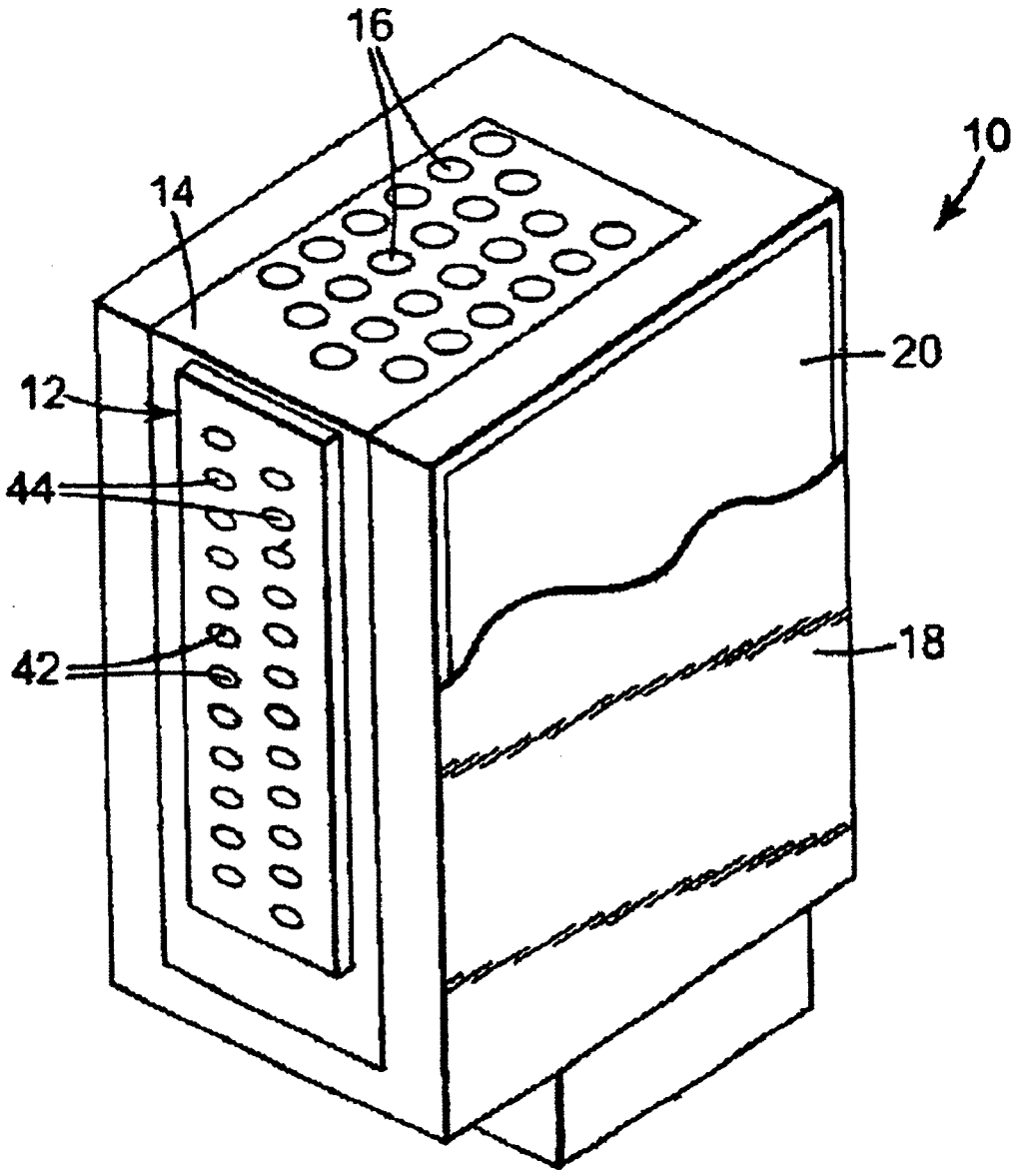
FIG. 1 is a perspective view of a cartridge incorporating a printhead with an integrated filter in accordance with an embodiment of the present invention.

A thermal ink jet print cartridge 10 having an ink jet printhead 12 in accordance with the present invention is illustrated generally in FIG. 1. In the ink jet cartridge 10, the printhead 12 is bonded onto a flex circuit 14 that couples control signals from electrical contacts 16 to the printhead 12. The printhead 12 and the flex circuit 14 are mounted to a cartridge housing 18 of the ink jet cartridge 10. Fluid ink is held within the housing 18 of the ink jet cartridge 10 in an ink fluid reservoir, such as a capillary storage member 20. The capillary storage member 20 is in fluid communication with the printhead 12 via a suitable fluid delivery assemblage which may include a standpipe (not shown).

Figure 2:
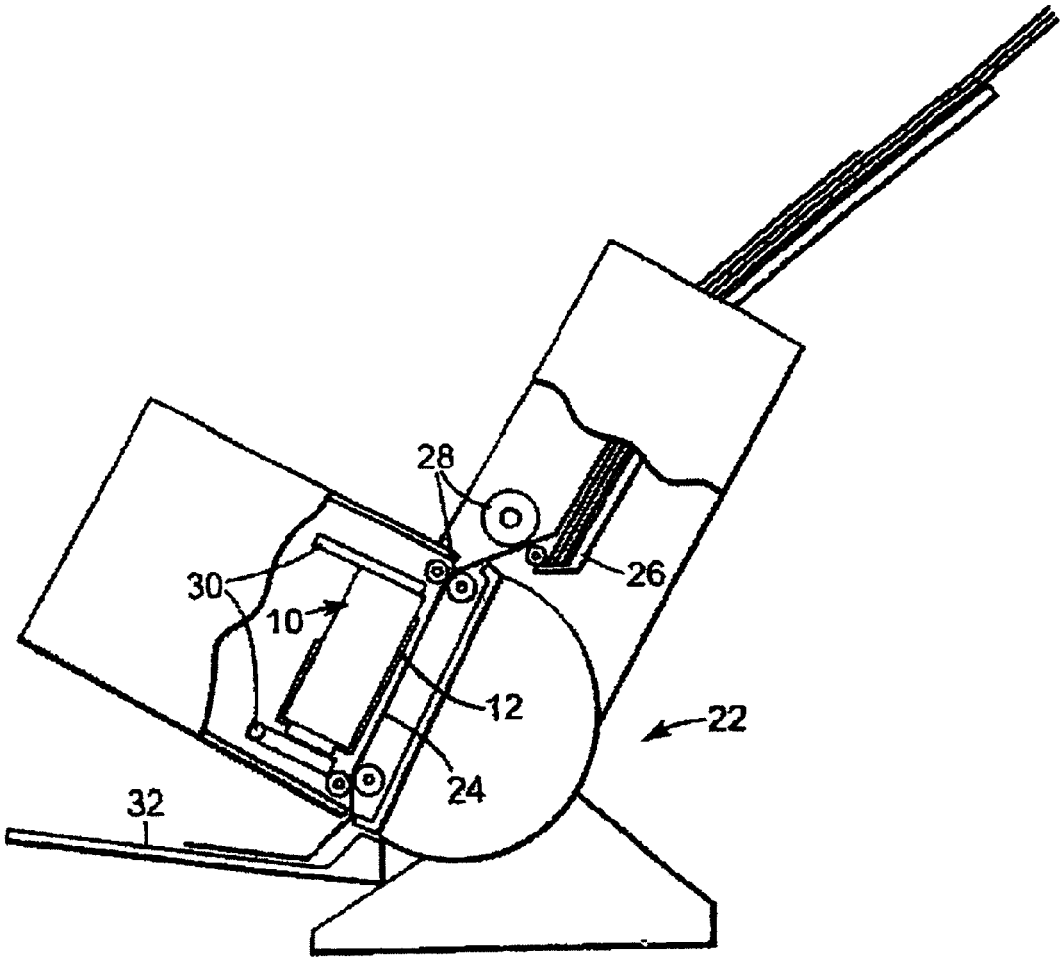
FIG. 2 is a side elevational view, partially in section, of a printer using the cartridge shown in FIG. 1.

As seen in FIG. 2, the ink jet cartridge 10 having the ink jet printhead 12 in accordance with the present invention, can be used in a thermal ink jet printer 22. Medium 24 (such as paper) is taken from a medium tray 26 and conveyed along its length across the ink jet cartridge 10 by a medium feed mechanism 28. The ink jet cartridge 10 is conveyed along the width of the medium 24 on a carriage assemblage 30. The medium feed mechanism 28 and carriage assemblage 30 together form a conveyance assemblage for transporting the medium 24. When the medium 24 has been recorded onto, it is ejected onto a medium output tray 32.

Figure 3:
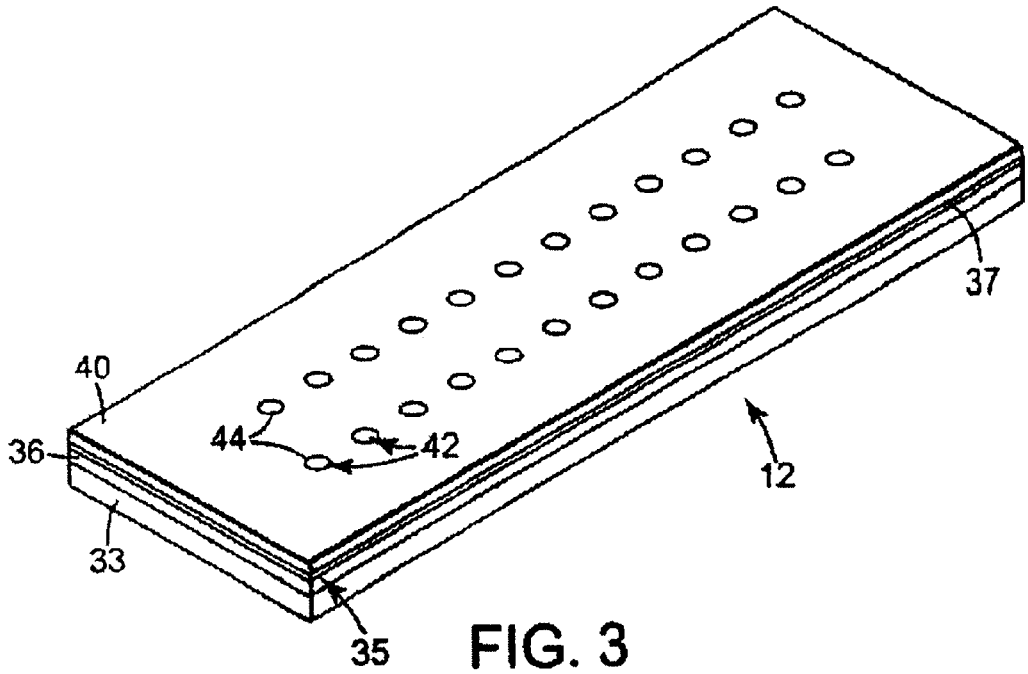
FIG. 3 is a perspective view of the printhead with integrated filter shown in FIG. 1.
Figure 4:
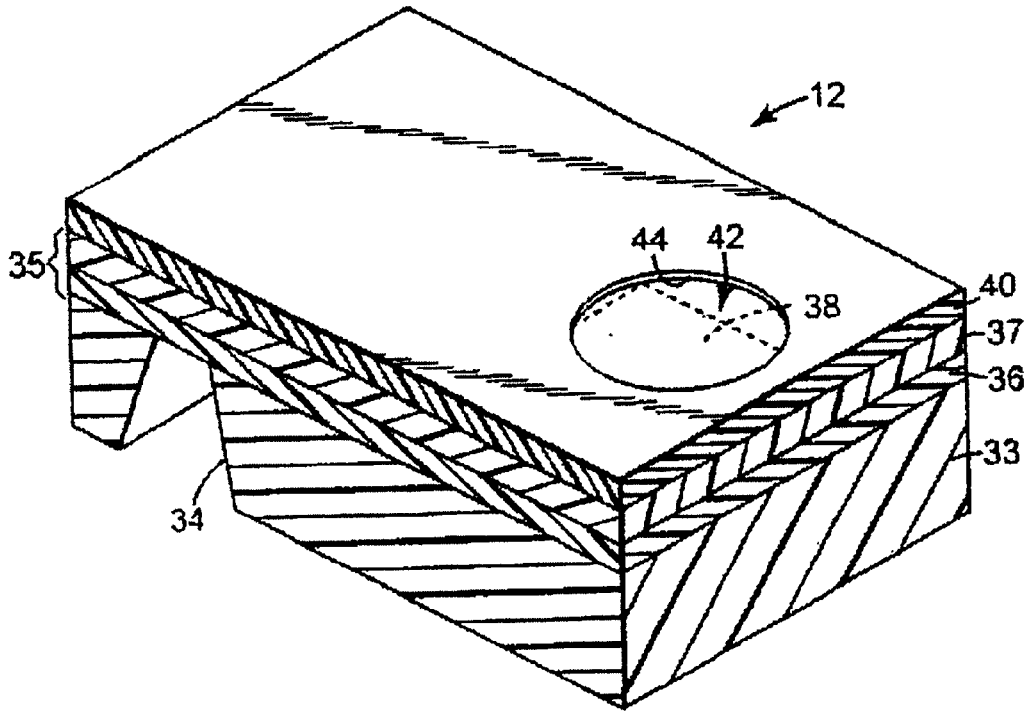
FIG. 4 is an enlarged sectional perspective view of a single firing chamber of the printhead with integrated filter shown in FIG. 3.

As seen best in FIGS. 3 and 4, the ink jet printhead 12, in accordance with one embodiment of the present invention, includes a first substrate, such as a semiconductor silicon substrate 33 that provides a rigid chassis for the printhead 12, and which accounts for the majority of the thickness of the printhead 12. The silicon substrate 33 defines an ink fluid supply conduit 34 that is in fluid communication with the capillary storage member 20 (i.e., ink fluid reservoir) of the ink jet cartridge 10. A second substrate 35 is affixed to the silicon substrate 33. The second substrate 35 includes a stack of thin film layers 36 and a barrier layer 37. The stack of thin film layers 36 is affixed to the silicon substrate 33, and the barrier layer 37 is affixed to the stack of thin film layers 36. The stack of thin film layers 36 includes a plurality of independently addressable ink energizing elements, such as resistors 38 (see FIG. 4). The resistors are electrically connected to an activation source (not shown for clarity) for providing electrical energy to the resistors 38 to heat them. An orifice layer 40 is affixed to the barrier layer 37. The orifice layer 40 is the uppermost layer of the ink jet printhead 12, and faces the medium 24 on which ink is to be printed. The orifice layer 40, barrier layer 37 and thin film layers defines a plurality of firing chambers 42. The firing chambers 42 are positioned over the resistors 38 of the stack of thin film layers 36, such that each firing chamber 42 is in registration with a respective resistor 38. Each of the firing chambers 42 opens through an orifice, such as a nozzle aperture 44 through which ink may be selectively expelled from the orifice layer 40 of the ink jet printhead 12.

FIGS. 5A–5G illustrate a sequence of steps for manufacturing an exemplary fluid ejecting device comprising an ink jet printhead 12 in accordance with one embodiment of the present invention. The silicon substrate 33 is provided in FIG. 5A. The silicon substrate 33 has a first or lower surface 46 and a second or upper surface 48. The silicon substrate 33 is a semiconductor silicon wafer about 625 $\mu$m thick, although glass or a stable polymer may be substituted. The stack of thin film layers 36 is affixed to the entire silicon substrate 33 in FIG. 5B. The stack of thin film layers 36 has a first or lower surface 50 and a second or upper surface 52. The stack of thin film layers 36 is formed in a known manner prior to be applied to the silicon substrate 33. The stack of thin film layers 36 is about 2 $\mu$m thick. The stack of thin film layers 36 include the plurality of resistors 38 and conductive traces (not shown). The stack of thin film layers 36 is laid down layer upon layer on the upper surface 48 of the silicon substrate 33.

Figure 5A:
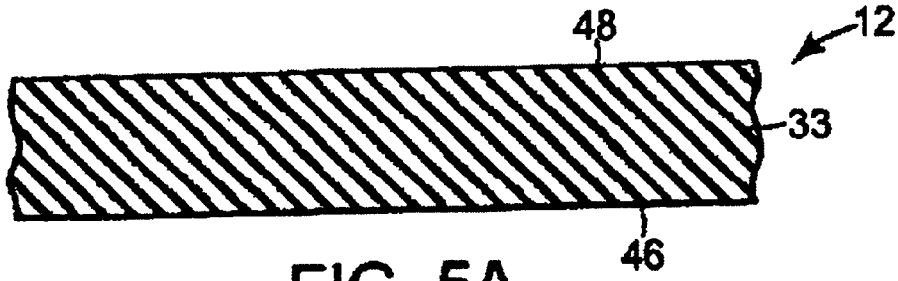
FIGS. 5A–5G are cross sectional views illustrating a sequence of manufacturing steps to form the printhead with integrated filter in accordance with an embodiment of the present invention.
Figure 5B:
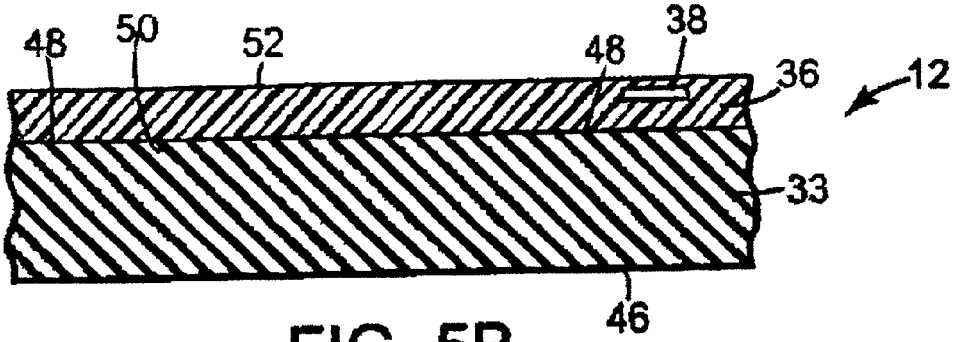
Figure 5C:
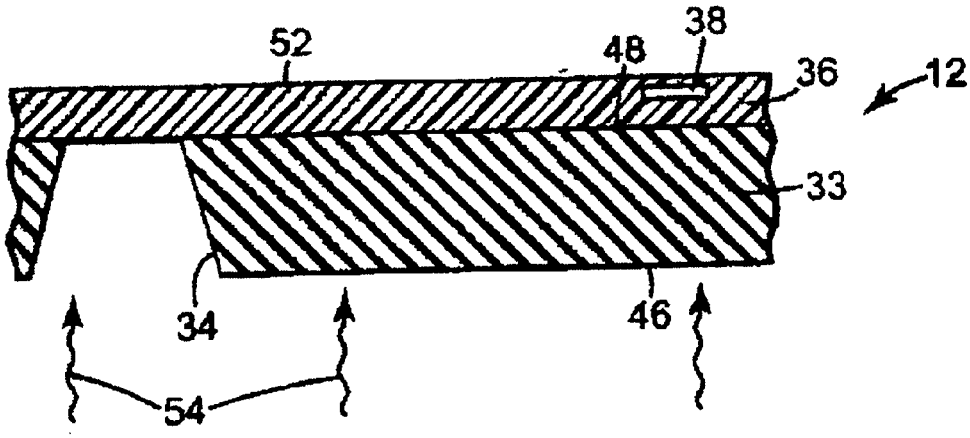

In FIG. 5C, the ink fluid supply conduit 34 is formed by selectively removing material from the silicon substrate 33 from the direction of the lower surface 46 of the silicon substrate. In particular, the ink fluid supply conduit 34 is etched in a known manner by anisotropic etching 54 (also known as wet chemical etching) to form the angled profile of the ink fluid supply conduit 34 shown in FIGS. 4 and 5C. The etching process ceases when the lower surface 50 of the stack of thin film layers 36 is reached. The position of the ink fluid supply conduit 34 in the silicon substrate 33 is dictated in a known manner through the use of a mask that determines where the etching process removes material from the silicon substrate 33. The ink fluid supply conduit 34 is a tapered trench that is widest at the lower surface 46 of the silicon substrate 33 to receive ink from the capillary storage member 20. The tapered trench narrows toward the stack of thin film layers 36. The tapered walls of the ink fluid supply conduit 34 have a wall angle of 54° from the plane of the silicon substrate 33. In essence the ink fluid supply conduit 34 is an ink fluid manifold that extends laterally along the silicon substrate 33 that is in fluid communication with more than one resistor 38.

Figure 5D:
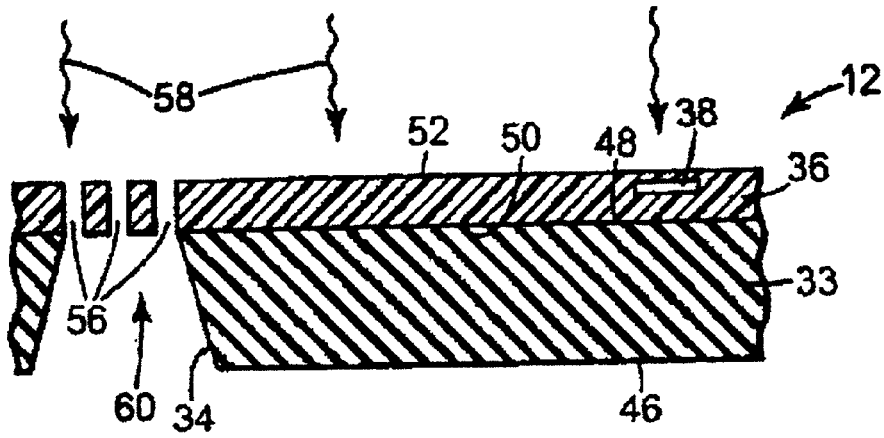

In FIG. 5D, a plurality of fluid filter openings 56 are formed by selectively removing material from the stack of thin film layers 36 from the direction of the upper surface 52 of the stack of thin film layers 36. In particular, the plurality of fluid filter openings 56 are etched in a known manner by isotropic etching 58 (also known as a dry plasma etch) to form fluid filter openings 56 in fluid communication with the ink fluid supply conduit 34 of the silicon substrate 33. In practice, the stack of thin film layers 36 is covered with a light sensitive photoresist polymer. A mask is then placed on top of this light sensitive photoresist polymer on the upper surface 52 of the stack of thin film layers 36. The mask determines where the eventual isotropic etching 58 process will remove material from the stack of thin film layers 36. The stack of thin film layers 36 is then exposed to ultraviolet (UV) light through the mask, which hardens (i.e., cures) those areas of the light sensitive photoresist polymer exposed to the UV light. The mask is then removed and an etching process etches away those areas of the light sensitive photoresist polymer that were not exposed to the UV light to define the plurality of fluid filter openings 56. The previously referenced isotropic etching 58 (i.e., dry plasma etch)

is then used to remove those areas of the thin film stack 36 to form the fluid filter openings 56 in the thin film stack 36. Alternatively, the fluid filter openings can be formed using the known process of laser ablation.

The fluid filter openings 56 function as an ink fluid filter 60 for the printhead 12. The fluid filter openings 56 filter the ink from the sponge 20 and preclude debris and air bubbles from reaching the firing chambers 42 of the printhead 12. The number of the fluid filter openings 56, the diameter of each of the fluid filter openings 56 and the thickness of the stack of thin film layers all determine the filter capabilities and capacity of the ink fluid filter 60. Preferably there are a plurality of fluid filter openings associated with each firing chamber 42 and each fluid filter opening 56 serves more than one firing chamber 42.

Figure 5E:
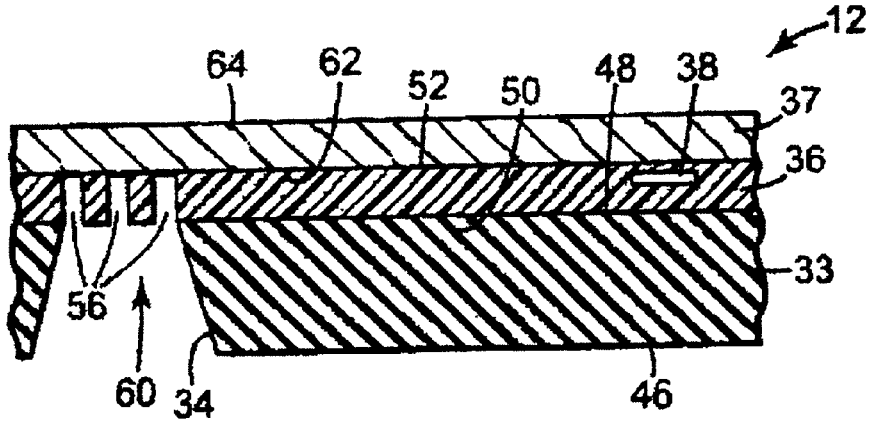

In FIG. 5E, the barrier layer 37 is affixed to the entire stack of thin film layers 36. The barrier layer 37 has a first or lower surface 62 and a second or upper surface 64. The barrier layers 37 is 3–30 $\mu$m thick and is a light sensitive photoresist polymer having a different etchant sensitivity than the stack of thin film layers 36. The lower surface 62 of the barrier layer 37 is affixed to the upper surface 52 of the stack of thin film layers 36, in a known manner, by placing the barrier layer 37 on the stack of thin film layers 36, then heating and applying pressure to the barrier layer 37 which causes the barrier layer 37 to adhere to the stack of thin film layers 36.

Figure 5F:
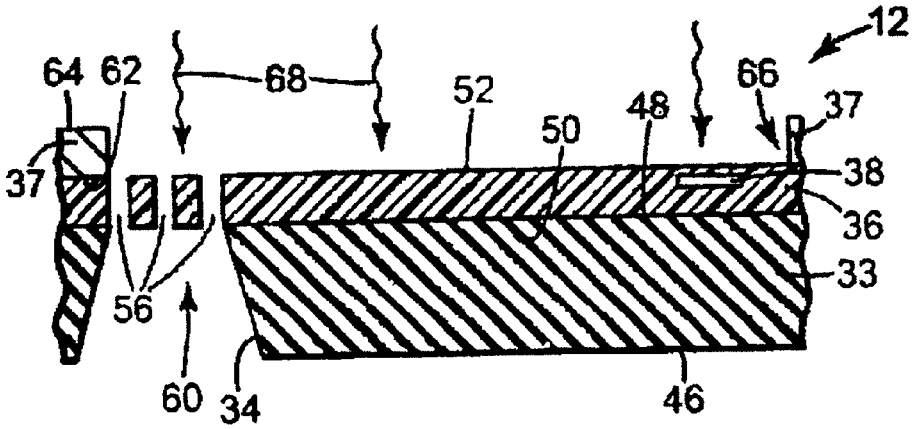

In FIG. 5F, a ink fluid channel 66 is formed by selectively removing material from the barrier layer 37 from-the direction of the upper surface 64 of the barrier layers 37. In particular, the fluid channel 66 runs laterally along the barrier layer 37, and is etched in a known manner by isotropic etching 68 (also known as a dry plasma etch) to form the fluid channel 66 which is in fluid communication with the fluid filter openings 56 and the resistors 38. In practice, since the barrier layer 37 is a light sensitive photoresist polymer, a mask is first placed on top of the upper surface 64 of the barrier layer 37. The mask determines where the etching process will remove material from the barrier layer 37. The barrier layer 37 is then exposed to ultra-violet (UV) light through the mask, which hardens (i.e., cures) those areas of the barrier layer 37 exposed to the UV light. The mask is then removed and the etching process etches away those areas of the barrier layer 37 that were not exposed to the UV light to form the fluid channel 66.

Figure 5G:
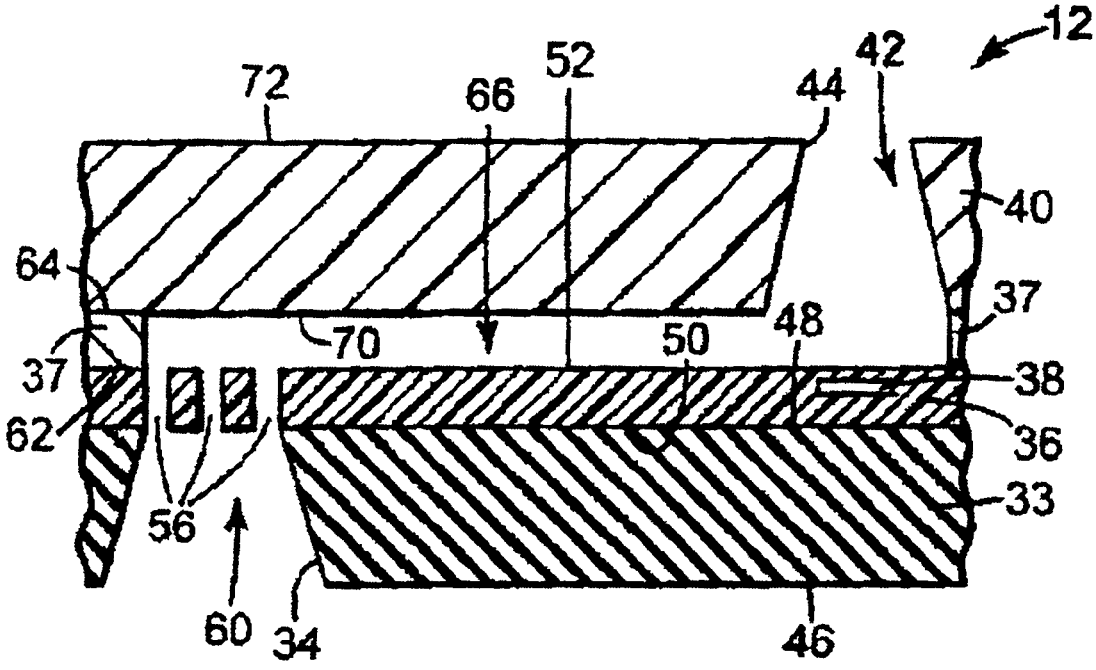

In FIG. 5G, the orifice layer 40 is affixed to the entire barrier layer 37. The orifice layer 40 has a first or lower surface 70 and a second or upper surface 72. The orifice layer 40 is about 30 $\mu$m thick and is either made of a light sensitive photoresist polymer or nickel (Ni). The lower surface 70 of the orifice layer 40 is affixed to the upper surface 64 of the barrier layer 37, in a known manner, by placing the orifice layer 40 on the barrier layer 37, then heating and applying pressure to the orifice layer 40 which causes the barrier layer 37 to adhere to the orifice layer 40. The firing chambers 42 are in registration with the resistors 38 of the stack of thin film layers 36. Each firing chamber 42 is generally frustoconical in shape with the wider portion positioned adjacent the respective resistor 38 and the narrower nozzle aperture 44 opening through the upper (i.e., exterior) surface 72 of the orifice layer 40.

The firing chambers 42 and nozzle apertures 44 are formed in a known manner in the orifice layer 40 prior to the orifice layer 40 being affixed to the barrier layer 37. In the case of a nickel orifice layer 40, the firing chambers 42 and nozzle apertures 44 are formed during the formation of the orifice layer itself using known electroforming processes. In the case of a light sensitive photoresist polymer orifice layer 40, the firing chambers 42 and nozzle apertures 44 are formed by selectively removing material from the orifice layer 40 from the direction of the lower surface 70 of the orifice layer 40. In particular, the firing chambers 42 and nozzle apertures 44 are etched in a known manner by isotropic etching (also known as a wet chemical etch). The manufacturing process for the first preferred embodiment of the ink jet printhead 12 having an integrated filter 60 is now complete and the printhead 12 is ready for mounting to the housing 18 of the ink jet cartridge 10.

Figure 6A:
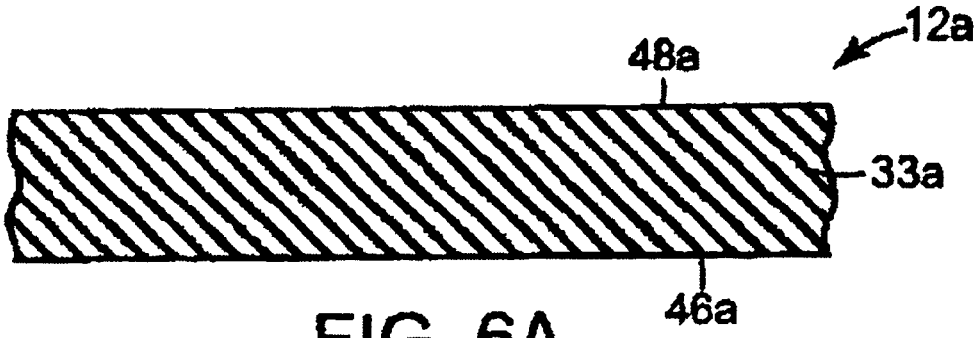
FIGS. 6A–6F are cross sectional views illustrating a sequence of manufacturing steps to form the printhead with integrated filter in accordance with an alternative embodiment of the present invention.
Figure 6B:
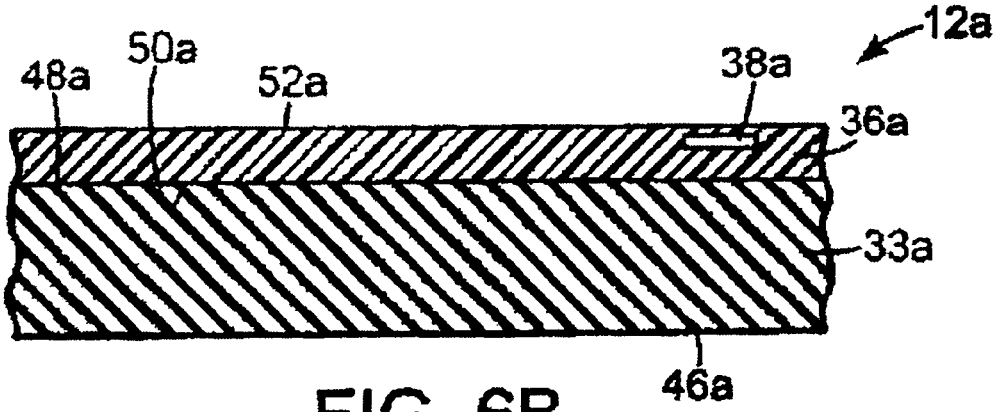

FIGS. 6A–6F illustrate a sequence of steps for manufacturing a second alternative ink jet printhead embodiment 12*a* in accordance with the present invention. Like parts are labeled with like numerals except for the addition of the subscript "a". The manufacturing steps and composition of printhead components illustrated in FIGS. 6A–6B are identical to the manufacturing steps and composition of printhead components illustrated in FIGS. 5A–5B and therefore will not be described with particularity.

Figure 6C:
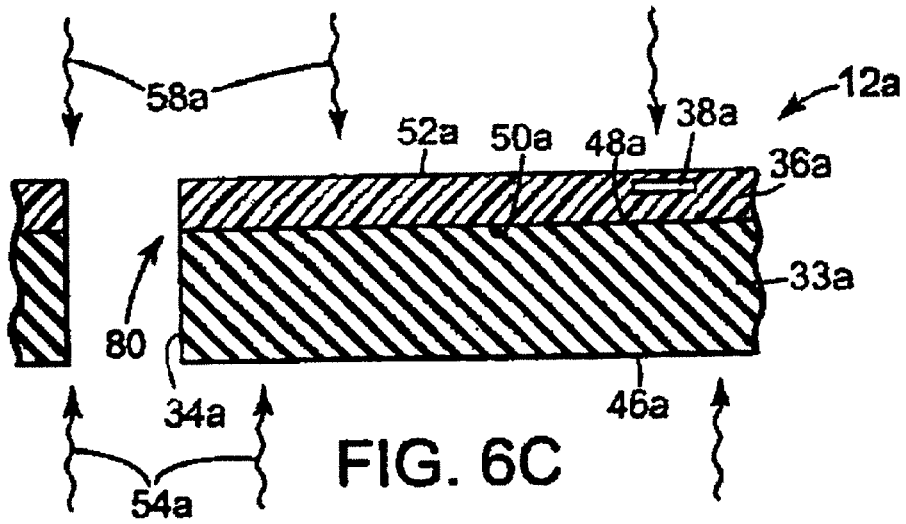

In FIG. 6C, the ink fluid conduit 34*a* and a fluid feed passageway 80 are formed by selectively removing material from the silicon substrate 33 and the stack of thin film layers 36*a,* respectively, from the direction of the lower surface 46*a* of the silicon substrate 33*a*. In particular, the ink fluid conduit 34*a* and the fluid feed passageway 80 are formed via sand blasting in a known manner. The silicon substrate 33*a* and the stack of thin film layers 36*a* are sand blasted using a sand blasting cutting tool that forms the ink fluid conduit 34*a* and a fluid feed passageway 80. In this instance, the walls of the ink fluid conduit 34*a* are straight as opposed to the angled side walls of the ink fluid conduit 34 in FIG. 5C. Alternatively, the ink fluid conduit 34*a* and the fluid feed passageway 80 can be formed using the known process of laser ablation.

Figure 6D:
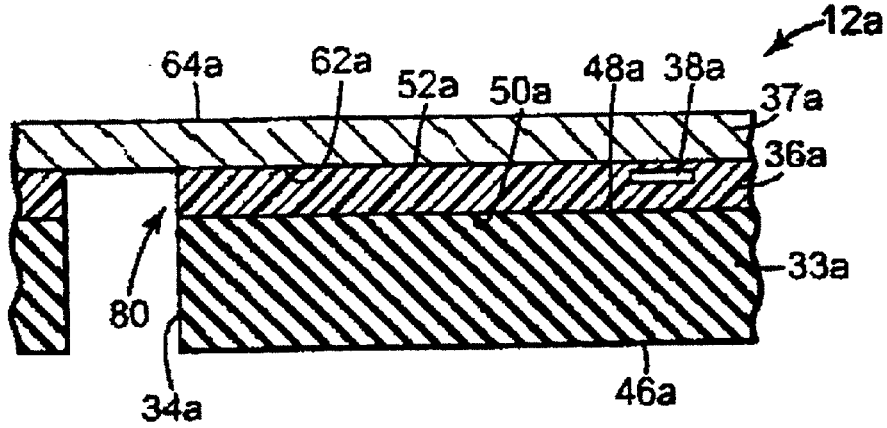

In FIG. 6D, the barrier layer 37*a* is affixed to the entire stack of thin film layers 36*a*. The barrier layer 37*a* has a first or lower surface 62*a* and a second or upper surface 64*a*. The barrier layer 37*a* is 3–30 $\mu$m thick and is a light sensitive photoresist polymer having a different etchant sensitivity than the stack of thin film layers 36*a.* The lower surface 62*a* of the barrier layer 37*a* is affixed to the upper surface 52*a* of the stack of thin film layers 36*a,* in a known manner, by placing the barrier layer 37*a* on the stack of thin film layers 36*a,* then heating and applying pressure to the barrier layer 37*a* which causes the barrier layer 37*a* to adhere to the stack of thin film layers 36*a*.

Figure 6E:
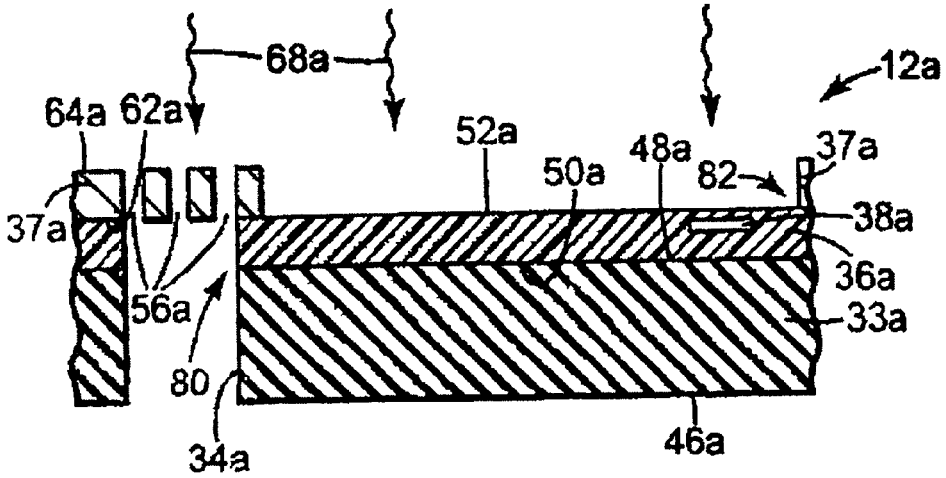

In FIG. 6E, a plurality of fluid filter openings 56*a* and a barrier layer fluid channel 82 are formed by selectively removing material from the barrier layer 37*a* from the direction of the upper surface 64*a* of the barrier layer 37*a*. In particular, the plurality of fluid filter openings 56*a* and the barrier layer fluid channel 82 are etched in a known manner by isotropic etching 68*a*. The fluid filter openings 56*a* are in fluid communication with the fluid feed passageway 80 of the stack of thin film layers 36*a*. The barrier layer fluid channel 82 is in fluid communication with the resistors 38*a*. In practice, since the barrier layer 37*a* is a light sensitive photoresist polymer, a mask is first placed on top of the upper surface 64*a* of the barrier layer 37*a*. The mask determines where the etching process will remove material from the barrier layers 37*a*. The barrier layer 37*a* is then exposed to ultra-violet (UV) light through the mask, which hardens (i.e., cures) those areas of the barrier layer 37*a* exposed to the UV light. The mask is then removed and the etching process etches away those areas of the barrier layer 37*a* that were not exposed to the UV light to form the plurality of fluid filter openings 56*a* and the barrier layer fluid channel 82.

The fluid filter openings 56*a* function as a compliant ink fluid filter 60*a* for the printhead 12*a*. The fluid filter openings 56*a* filter the ink from the capillary storage member 20 and preclude debris and air bubbles from reaching the firing chambers 42*a* of the printhead 12*a*. The number of the fluid filter openings 56*a*, the diameter of each of the fluid filter openings 56*a* and the thickness of the barrier layer 37*a* all determine the filter capabilities and capacity of the ink fluid filter 60*a*.

Figure 6F:
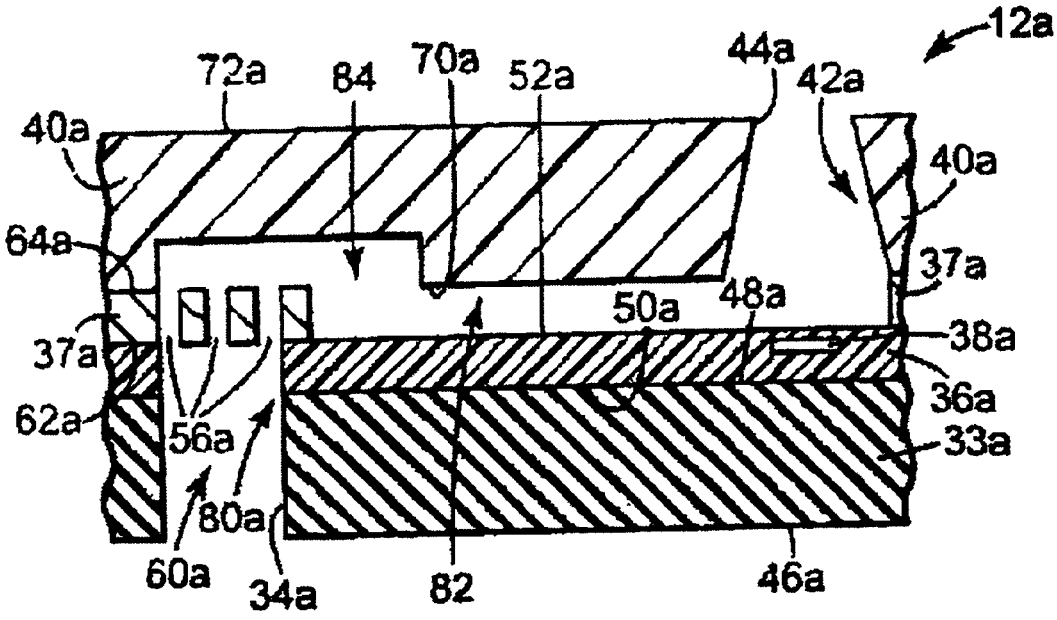

In FIG. 6F, the orifice layer 40*a* is affixed to the entire barrier layer 37*a*. The orifice layer 40 has a first or lower surface 70*a* and a second or upper surface 72*a*. The orifice layer 40*a* is 10–30 μm thick and is either made of a light sensitive photoresist polymer or nickel (Ni). The lower surface 70*a* of the orifice layer 40*a* is affixed to the upper surface 64*a* of the barrier layer 37*a*, in a known manner, as previously described in relation to FIG. 5G. The firing chambers 42*a* are in registration with the resistors 38*a* of the stack of thin film layers 36*a*, and are in fluid communication with the barrier layer fluid channel 82. Each firing chamber 42*a* is generally frustoconical in shape with the wider portion positioned adjacent the respective resistor 38*a* and the narrower nozzle aperture 44*a* opening through the upper (i.e., exterior) surface 72*a* of the orifice layer 40*a*.

The firing chambers 42*a* and nozzle apertures 44*a* and an orifice layer fluid channel 84 are formed in a known manner in the orifice layer 40*a* prior to the orifice layer 40*a* being affixed to the barrier layer 37*a*. The orifice layer fluid channel 84 is in fluid communication with the barrier layer fluid channel 82 and the fluid filter openings 56*a*. In the case of a nickel orifice layer 40*a*, the firing chambers 42*a*, the nozzle apertures 44*a* and the orifice layer fluid channel 84 are formed into the orifice layer itself using known electroforming processes. In the case of a light sensitive photoresist polymer orifice layer 40*a*, the firing chambers 42*a*, the nozzle apertures 44*a* and the orifice layer fluid channel 84 are formed by selectively removing material from the orifice layer 40*a*. The manufacturing process for the second alternative embodiment of the ink jet printhead 12*a* having an integrated filter 60*a* is now complete and the printhead 12*a* is ready for mounting to the housing 18 of the ink jet cartridge 10.

Figure 7:
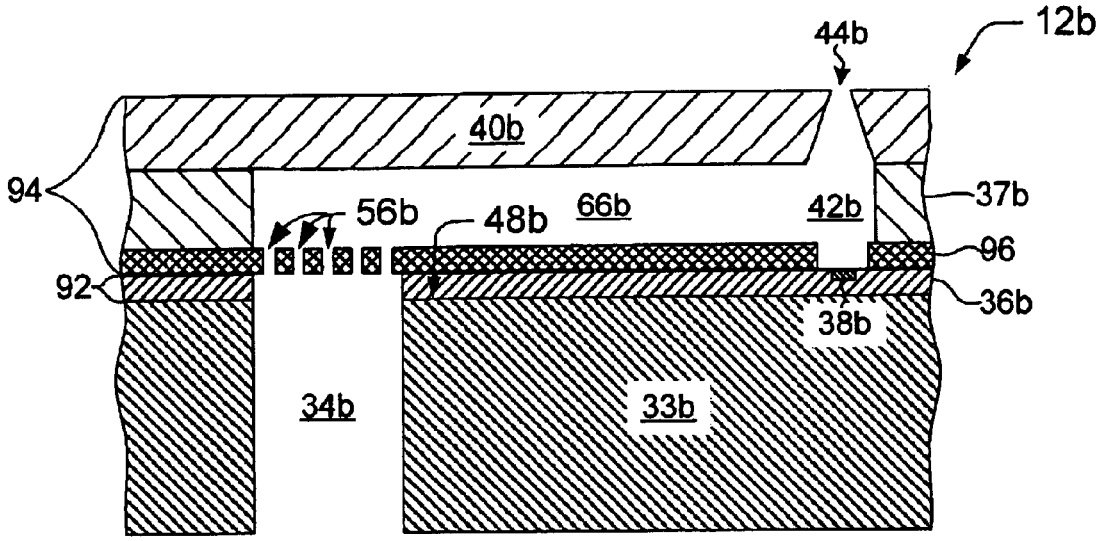
FIG. 7 illustrates a cross-sectional view of one exemplary fluid ejection device in accordance with one embodiment.

FIG. 7 shows another alternative print head 12*b*. Silicon substrate 33*b* defines a fluid supply conduit 34*b* formed therein. A first layer assembly 92 is formed over the silicon substrate's second surface 48*b*, and a second layer assembly 94 is formed over the first layer assembly. First layer assembly 92 is intended primarily to form electrical components, such as resistor 38*b*. In this particular embodiment, first layer assembly 92 comprises multiple thin film layers 36*b*.

Second layer assembly 94 primarily performs mechanical functions including fluid transport. In this embodiment, second layer assembly 94 comprises a first or primer layer 96. Suitable primer layer materials can include any material which tends to be relatively elastic and non-brittle. Examples of suitable primer materials include various polymers among others. In some embodiments, primer layer 96 can contribute to greater adhesion and continuity between the thin films 36*b* of first layer assembly 92 and the overlying layers of the second layer assembly 94 than occurs in the absence of the primer layer.

In this instance, primer layer 96 is also configured to filter fluid and has multiple fluid filter openings 56*b* formed therein. Fluid can pass from fluid supply conduit 34*b* through the fluid filter openings 56*b*. In one embodiment, primer layer 96 can comprise a patternable material which has different etchant sensitivity than the thin films 36*b*. For example, primer layer 96 can comprise a patternable polymer. Some suitable polymers have molecular cross-linking which can contribute to a generally elastic and non-brittle primer layer. One such example can be a photo-imagable polymer such as SU8.

Second layer assembly 94 also comprises barrier layer 37*b* and orifice layer 40*b*. The barrier and orifice layers can define fluid channel 66*b*, firing chambers 42*b* and nozzle apertures 44*b*. Fluid channel 66*b* fluidly couples fluid filter openings 56*b* and firing chambers 42*b*. In some embodiments, barrier and orifice layers 37*b*, 40*b* comprise the same material as primer layer 96. In other embodiments, the barrier layer comprises a polymer material while the orifice layer comprises a sputtered nickel material.

FIGS. 7*a*–7*g* illustrate exemplary process steps for forming print head 12*b* shown in FIG. 7. For the purposes of illustration, patterned material may be removed upon patterning. Some suitable embodiments may delay removal of patterned material until a subsequent process step.

Figure 7A:
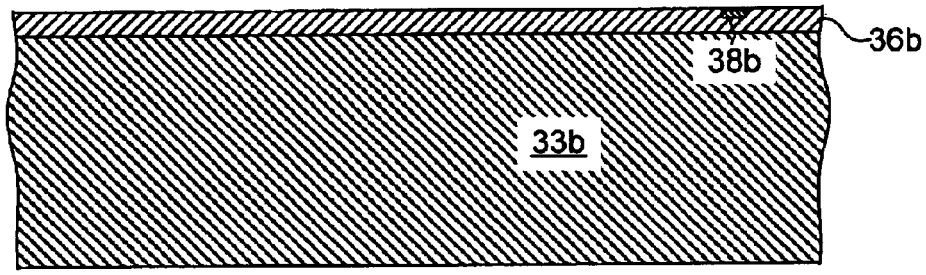
FIGS. 7A–7G are cross sectional views illustrating a sequence of manufacturing steps to form the printhead with integrated filter in accordance with an alternative embodiment of the present invention.

FIG. 7*a* illustrates the formation of one or more thin films 36*b* over substrate 33*b*. The thin films can be formed utilizing known techniques, some of which are described above. In one such example, the thin films can be patterned and etched to form various conductive leads (not shown) and one or more resistors 38*b*.

Figure 7B:
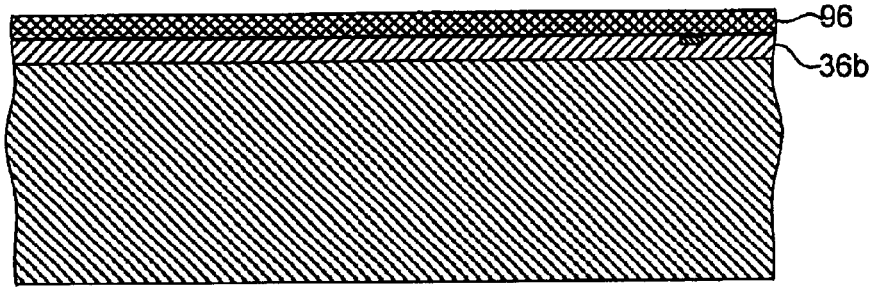

FIG. 7*b* illustrates the formation of primer layer 96 over thin films 36*b*. In one suitable process primer layer 96 comprises a polymer layer which is spun-on over thin films 36*b*. In alternative embodiments, the primer layer can be laminated onto the thin films or formed through vapor deposition. In one particular embodiment, primer layer 96 can be patterned and then positioned over and laminated to the thin films.

Figure 7C:
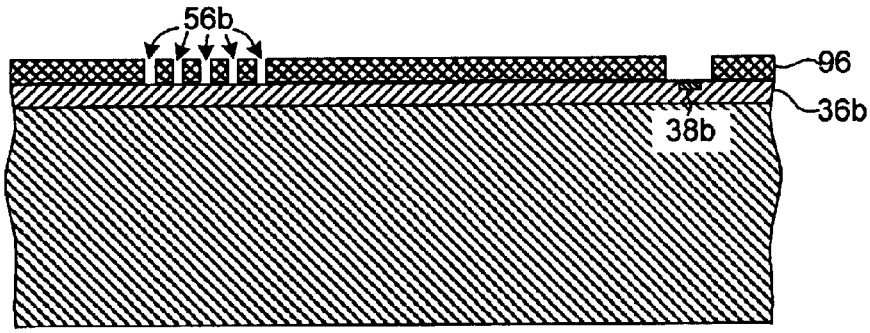

FIG. 7*c* shows primer layer 96 patterned to form multiple fluid filter openings 56*b*. In this implementation, primer layer 96 is also patterned over resistor 38*b* to increase a rate of energy transfer from the resistor to fluid contained in respective firing chamber 42*b* shown FIG. 7. The skilled artisan will recognize suitable processes for patterning the primer layer such as masking and exposure to UV light. Other suitable embodiments may utilize laser ablation among other processes.

Figure 7D:
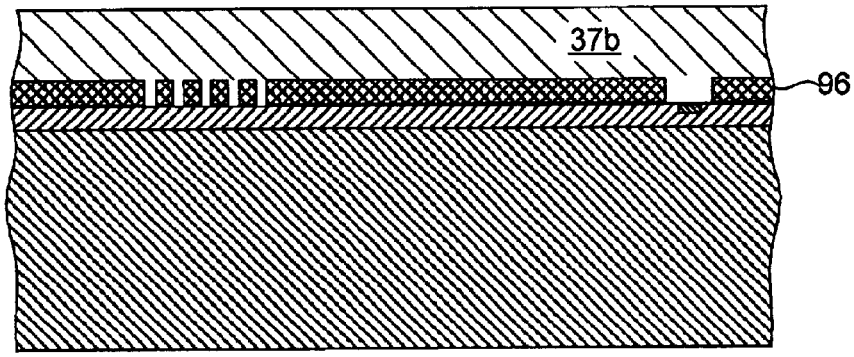

FIG. 7*d* illustrates the formation of barrier layer 37*b* over primer layer 96. In some embodiments, barrier layer 37*b* comprises the same material as primer layer 96 and is spun-on in a similar manner.

Figure 7E:
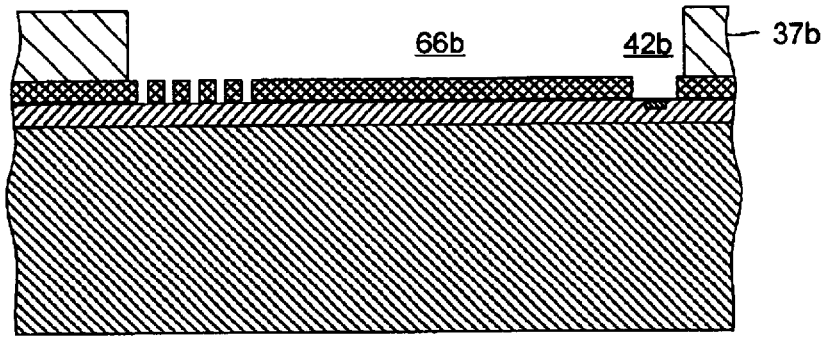
Figure 7E:
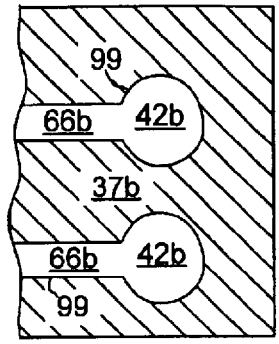

FIG. 7*e* illustrates the patterning of barrier layer 37*b* to form at least portions of fluid channel 66*b* and firing chamber 42*b*. The patterning process forms these fluid channels and firing chambers by removing barrier material corresponding to individual fluid channels 66*b* and firing chambers 42*b* and leaving barrier material 37*b* which defines and separates the individual fluid channels and firing chambers from one another. For example, FIG. 7*e*′shows a top view of a patterned barrier layer 37*b* configured so that remaining barrier material forms and separates individual fluid channels 66*b* and firing chambers 42*b* by forming sidewalls 99 thereof. The skilled artisan should recognize that some embodiments may form part or all of fluid channels and firing chambers with the orifice layer.

Following the patterning step described in relation to FIGS. 7*e*–7*e*′the patterned areas 42*b*, 66*b* of barrier layer

38*b* are filled with a sacrificial material such as, for example, photoresist, polyimides, silicon dielectric, siloxane polymers and, acrylic resins. The barrier layer's top surface is then leveled or planarized.

Figure 7F:
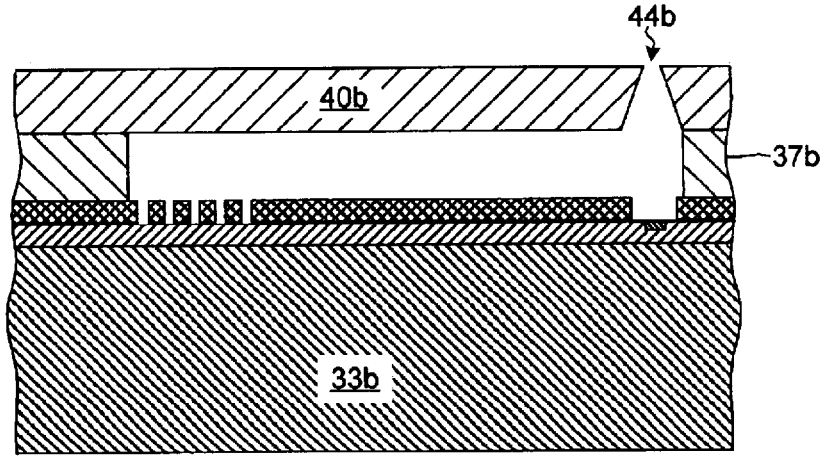

FIG. 7*f* illustrates the formation of orifice layer 40*b* over barrier layer 37*b*. In this particular process, the orifice layer is spun-on over barrier layer 37*b*. One or more nozzle apertures 44*b* are then patterned into orifice layer 40*b*. Other suitable embodiments may form the orifice layer by performing nozzle apertures in an orifice material which is then positioned over the barrier layer.

The patterned orifice material and the underlying sacrificial material are removed. Substrate 33*b* and associated layers are then baked to cross link the polymer layers.

Figure 7G:
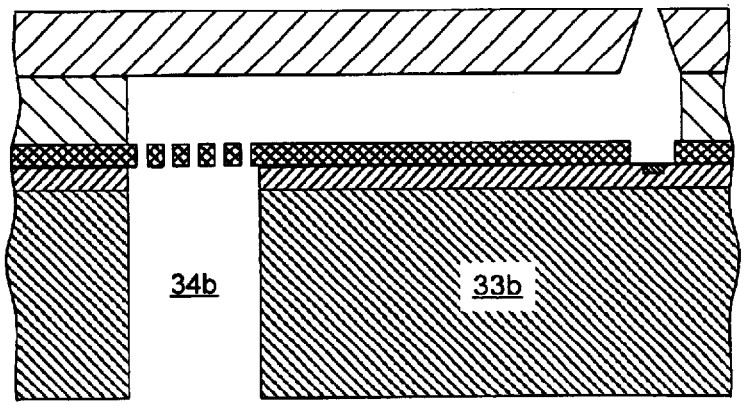

FIG. 7*g* illustrates the formation of fluid supply conduit 34*b* into substrate 33*b*. The fluid supply conduit can be formed utilizing any suitable technique or techniques. For example, fluid supply conduit 34*b* can be etched into the substrate utilizing, for example, either dry etching, wet etching, or a combination thereof. In another example, a portion of fluid supply conduit 34*b* can be formed from the substrate's first side before or interposed with the above described process steps and then the fluid supply conduit can be completed by etching through the rest of the substrate.

Figure 8:
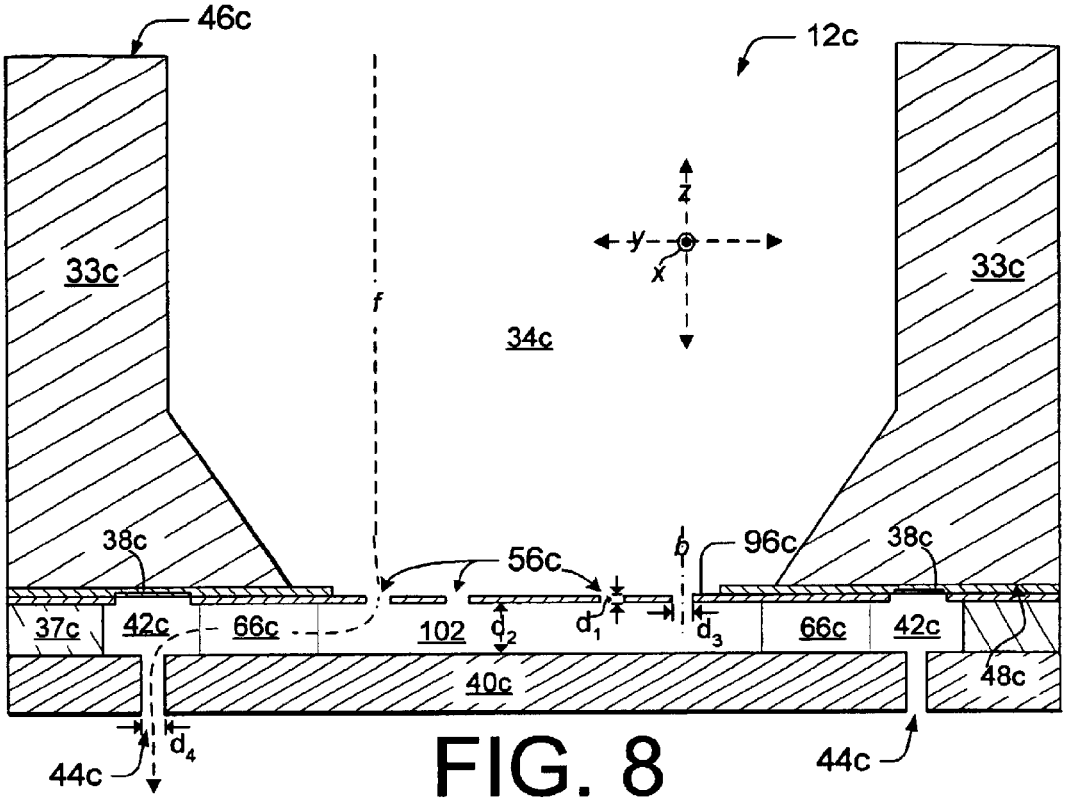
FIG. 8 illustrates a cross-sectional view of one exemplary fluid ejection device in accordance with one embodiment.
Figure 9:
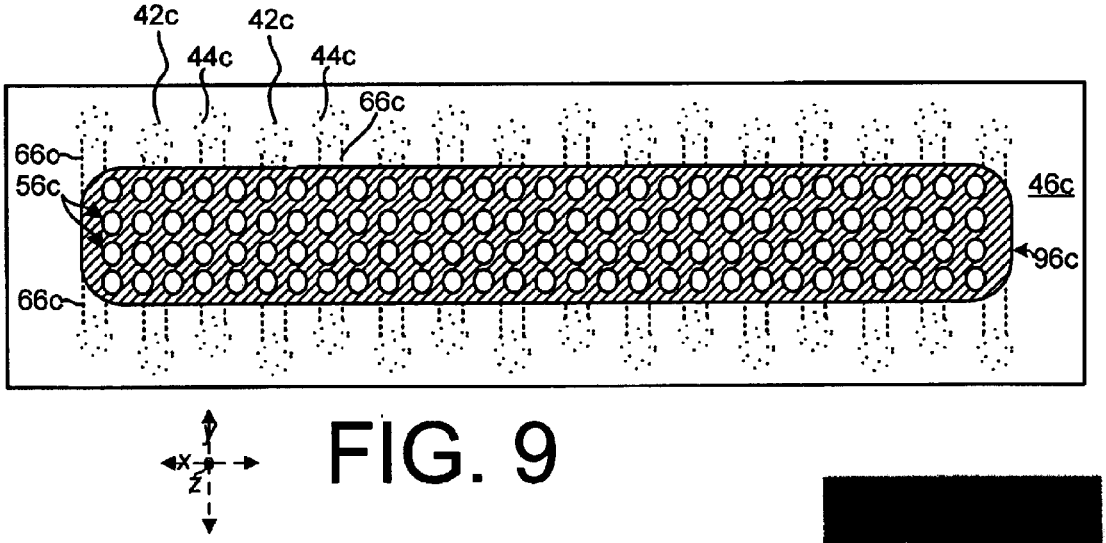
FIG. 9 illustrates a top view of the embodiment shown in FIG. 8.

FIGS. 8–9 show another exemplary print head 12*c*. FIG.8 illustrates a cross-section taken transverse to the print head's long axis x which extends into and out of the page on which FIG. 8 appears.

FIG. 9 illustrates a view along the x axis taken from above the substrate's first surface 46*c*. For the purposes of illustration, FIG. 9 shows underlying nozzle apertures 44*c*, firing chambers 42*c* and fluid channels 66*c* in dashed lines.

As best appreciated with respect to FIG. 8, in this embodiment, fluid travels along a fluid feed path f which is defined, at least in part, by fluid supply conduit 34*c*, fluid filter openings 56*c*, fluid channel 66*c* firing chamber 42*c* and nozzle aperture 44*c*. In this embodiment, fluid filter openings 56*c* are formed in primer layer 96, while fluid channel 66*c* and firing chamber 42*c* are formed in barrier layer 37*c*. Nozzle aperture 44*c* is formed in orifice layer 40*c*. This illustrated embodiment has a common plenum 102 below fluid filter openings 56*c* from which the fluid channels 66*c* originate. However, other suitable embodiments may have individual fluid channels originating directly beneath a dedicated group of filter openings. Such an example is described below in relation to FIGS. 13–15.

Primer layer 96*c* can be any suitable thickness $d_1$. Suitable embodiments can have primer layers of 1 micron or less, or as thick as is desired. Some of the described embodiments utilize relatively thin primer layers to minimize any effect on fluid flow. In one such example, primer layers in a range of about 1 micron to about 5 microns are utilized, with one particular embodiment utilizing 2 microns. Primer layer thickness can also be selected relative to a depth $d_2$ of the fluid channel 66*c*. In one embodiment, the primer layer thickness can be less than about 20 percent of the fluid channel's depth. Such embodiments allow relative size relationships to be maintained if print head is further miniaturized.

In this embodiment the fluid filter openings 56*c* of primer layer 96*c* have a bore b which is generally perpendicular to substrate's second surface 48*c*. Orienting the fluid filter opening's bore generally perpendicularly to the second surface can effectively filter contaminants from reaching the firing chambers with minimal increase in backpressure, and allow higher relative flow than other configurations.

For example, in this embodiment fluid filter openings 56*c* are sized slightly smaller than the size of the print head's nozzle apertures 44*c* to reduce nozzle blockage during operation of the print head. In this example fluid filter opening sizes are based on a dimension $d_3$ taken transverse their bore b that is less than the nozzle aperture's dimension $d_4$ taken transverse the fluid flow path. This configuration can reduce the likelihood of contaminants carried by the fluid becoming lodged in a nozzle aperture. In one such example, individual fluid filter openings 56*c* have a dimension $d_3$ that is about 13–14 microns while the nozzle aperture's dimension $d_4$ is about 15–16 microns. This is but one illustrative example. Other suitable embodiments can have aperture dimensions that are less than about 0.3 to over 2 times the nozzle aperture dimension. The primer layer's fluid filter openings are readily scalable to smaller dimensions if drop size and associated nozzle dimensions are reduced in future print head technologies.

Figure 10:
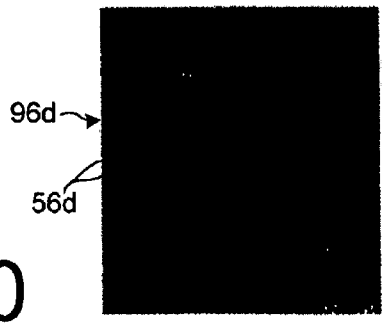
FIGS. 10–11 illustrate microscopy views in accordance with one exemplary embodiment.

In the embodiment shown in FIG. 9, the fluid filter openings comprise about one-half of the surface area of primer layer 96*c* overlying fluid feed conduit 34*c*. Other suitable embodiments can maximize the relative amount of patterned area relative to remaining primer material. FIG. 10 shows a microscopy image of one such embodiment referred to as a hexagonal close pack arrangement of fluid filter openings 56d formed in a primer layer 96*d*. This arrangement generally resembles a honeycomb. The skilled artisan will recognize that embodiments such as this one and those described above and below can have built in redundancy of fluid supply paths to the firing chambers. For example, if several fluid filter openings become clogged with contaminants, nearby openings can maintain adequate flow to adjacent firing chambers.

In the embodiments described above, the fluid filter openings are generally uniform in size. Other suitable embodiments may utilize fluid filter openings of various sizes.

Figure 11:
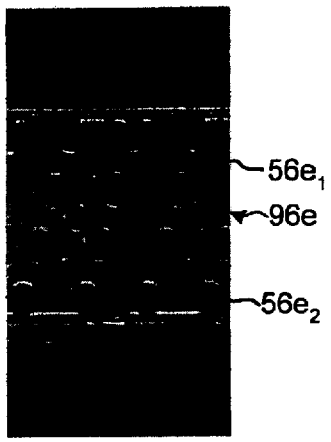

FIG. 11 shows an embodiment utilizing a primer layer 96*e* that has two sizes of fluid filter openings. In this embodiment, fluid filter openings comprise a first size $\mathbf{56}e_1$ and a second larger size $\mathbf{56}e_2$.

In this particular embodiment, both first and second size openings $\mathbf{56}e_1$, $\mathbf{56}e_2$ are smaller than the nozzle aperture, which though not shown is similar to nozzle apertures 44*c* shown and described in relation to FIG. 8. In this particular embodiment, first size openings $\mathbf{56}d_1$ are about 6 microns while second size openings are about 9 microns.

Figure 12:
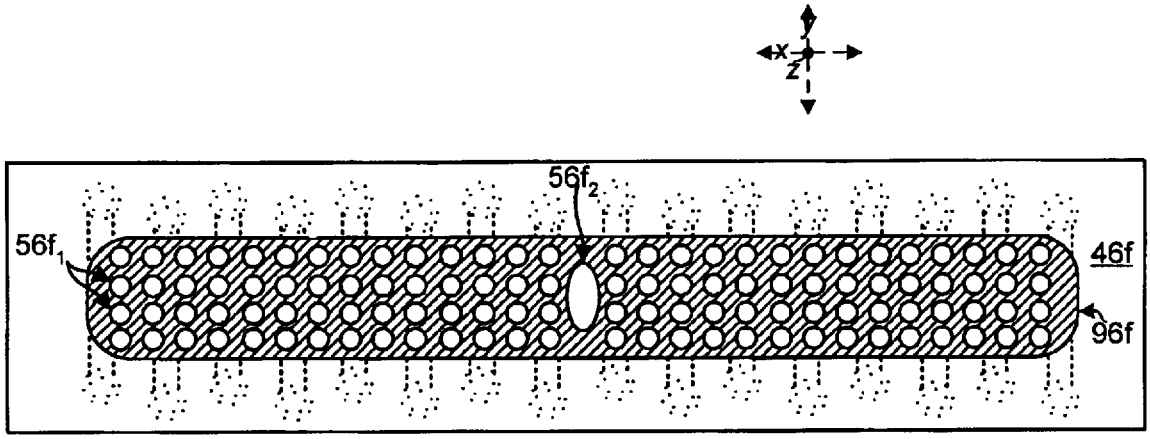
FIG. 12 illustrates a top view of one exemplary fluid ejection device in accordance with one embodiment.

FIG. 12 shows a top view of a substrate 46*f* similar to the view illustrated in FIG. 9. This embodiment provides a means of evacuating a bubble or bubbles located below primer layer 96*f*. In this embodiment, fluid filter openings comprise first size $\mathbf{56}f_1$ and a second larger size $\mathbf{56}f_2$. In this particular embodiment, first size openings $\mathbf{56}f_1$ are smaller than the embodiment's nozzle apertures (not shown) while second larger size opening $\mathbf{56}f_2$ is larger than the nozzle apertures. In this particular embodiment second aperture 806 is about 20–30 microns wide and 50–60 microns long.

Such a configuration having multiple smaller openings and one or more larger openings can effectively filter a majority of the fluid that enters the firing chambers 42*f* while providing an opening through which a bubble or bubbles may easily pass to migrate away from the print head. Though a single larger opening is shown in FIG. 12, other suitable configurations may utilize more than one. For example, one suitable embodiment may position a larger opening in the primer layer at each end of the fluid supply conduit.

Figure 13:
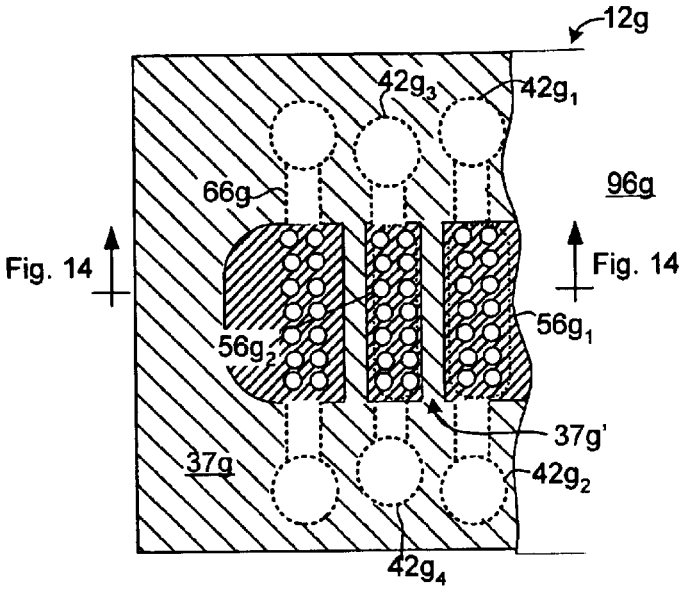
FIG. 13 illustrates a top view of one exemplary fluid ejection device in accordance with one embodiment.
Figure 14:
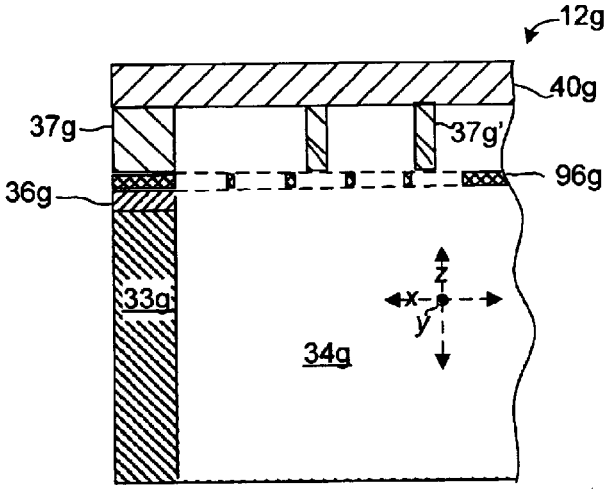
FIG. 14 illustrates a cross-sectional view of the exemplary fluid ejection device shown in FIG. 13.

FIGS. 13–14 show a partial view of another exemplary fluid ejecting device 12*g*. FIG. 13 shows a top view of barrier layer 37*g* patterned over patterned primer layer 96*g*. FIG. 14 shows a side-sectional view of fluid delivery conduit 34*g* formed in substrate 33*g*. For purposes of illustration FIG. 14 additionally shows orifice layer 40*g* positioned over barrier layer 37*g*. The orifice layer is not shown in FIG. 13 to allow the underlying features to be more readily visible.

In this embodiment, barrier layer 37*g* is patterned to leave barrier material extending over slot 34*g*. This remaining barrier material indicated generally at 37*g*′serves to fluidly isolate adjacent firing chambers from one another. In this particular embodiment, firing chambers $\mathbf{42}g_1$ and $\mathbf{42}g_2$ receive fluid from a distinct set of fluid filter openings $\mathbf{56}g_1$, while firing chambers $\mathbf{42}g_3$ and $\mathbf{42}g_4$ receive fluid from a second distinct set of fluid filter openings $\mathbf{56}g_2$.

Figure 15:
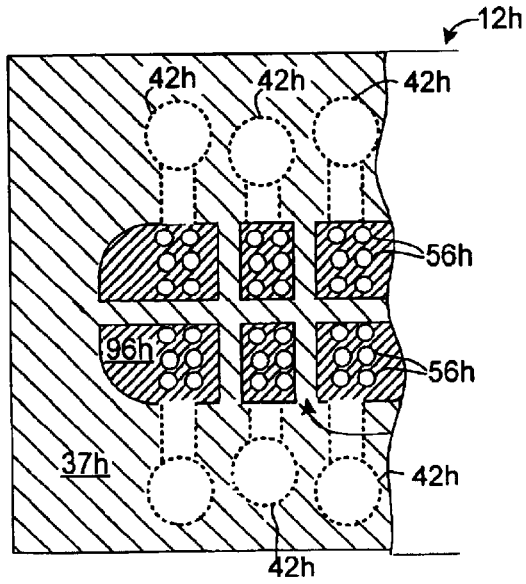
FIG. 15 illustrates a top view of one exemplary fluid ejection device in accordance with one embodiment.

FIG. 15 shows a partial view of another exemplary fluid ejecting device 12*h*. The view shown in FIG. 15 is a top view similar to that shown in FIG. 13. In this embodiment, barrier layer 37*h* is patterned to leave barrier material extending over slot 34*h* in such a manner as to supply fluid to each individual firing chamber 42*h* from a distinct set of fluid filter openings 56*h*.

The embodiments shown in FIGS. 13–15 fluidly isolate various firing chambers. Such embodiments can dampen pressure surges rather than propagating them along the print head. This dampening effect is further enhanced by the primer layer's generally elastic characteristics. Such a configuration utilizing fluidic isolation and the elastic primer layer can dissipate backflow from individual firing chambers into adjacent firing chambers.

For ease of illustration, the embodiments, described above utilize a single primer layer and a single barrier layer. Other suitable embodiments may utilize one or more sub-layers to form the primer layer and/or the barrier layer.

The embodiments described above position the primer layer and its patterned fluid filter openings over the substrate's second surface between the thin film layers and the barrier layer. Some embodiments may alternatively or additionally form the patterned primer layer above the substrate's first surface. In one such embodiment, a fluid supply conduit is formed in the substrate and filled with a sacrificial material. The primer layer is then formed over the substrate's first surface and the sacrificial material removed. Such a sacrificial process can also be utilized to form a primer layer over the thin films subsequent to fluid supply conduit formation.

In summary, by integrating the filter for the ink of a thermal ink jet cartridge into the ink jet cartridge printhead itself, the filter is mounted to the ink jet cartridge when the printhead is attached to the cartridge instead of separately as in prior art designs. This results in the elimination of ink jet cartridge assembly steps which translates into manufacturing cost savings. In addition, since the unitary printhead and filter of the present invention is manufactured using semiconductor manufacturing processes, the resulting unitary printhead and filter is very precise and hence extremely reliable. Therefore, the printhead and integrated filter should perform dependably throughout the useful life of the ink jet cartridge so as to preclude premature replacement of the ink jet cartridge and the associated cost. Moreover, the filter of the unitary printhead and filter, substantially precludes debris and air bubbles from clogging, restricting the flow of ink, and/or otherwise interfering with operation of the printhead components, such as the resistors and the firing chambers. In addition, the close proximity of the filter to the firing chambers allows the back flow of ink created upon firing of the firing chambers to dislodge bubbles and/or debris at the filter. The filter is extremely effective against pressure and spike surges of ink that can occur during normal operation of the ink jet cartridge or when the ink jet cartridge is jarred or dropped since the filter is somewhat compliant so as to absorb some of these surges and is integrated into the printhead and not at the head of the ink jet cartridge standpipe as in prior art designs.

Although the present invention has been described with reference to preferred embodiments, workers skilled in the art will recognize that changes may be made in form and detail without departing from the spirit and scope of the invention.

What is claimed is:

1. A fluid ejection device comprising:

a first substrate having a first surface, the substrate defining a fluid supply conduit extending through the substrate from the first surface;

a stack of thin film layers having a first surface and a second surface, the first surface of the stack of thin film layers being affixed to the first surface of the substrate, the stack of thin film layers including at least one fluid energizing element;

a second substrate having a first surface affixed to the second surface of the stack of thin film layers, the second substrate primarily configured to filter fluid and not primarily to form fluid channels and firing chambers and wherein the second substrate has at least one fluid filter opening formed over the fluid-supply conduit; and, a third substrate positioned over the second substrate and defining, at least in part, multiple fluid channels and multiple firing chambers.

2. The fluid ejection device of claim 1 wherein the second substrate comprises a polymer substrate.

3. The fluid ejection device of claim 1 wherein the second substrate comprises a patternable polymer substrate.

4. The fluid ejection device of claim 1 wherein the second substrate comprises a photo-imagable polymer substrate.

5. The fluid ejection device of claim 1 wherein the third substrate comprises a photo-imagable polymer barrier layer.

6. The fluid ejection device of claim 1 wherein the third substrate comprises a photo-imagable polymer substrate configured to perform the function of both a barrier layer and an orifice layer.

7. The fluid ejection device of claim 1 wherein the second and third substrates comprise the same material.

8. A fluid ejection device comprising:

a substrate defining a fluid supply conduit;

a first layer assembly positioned over the substrate, the first layer assembly being primarily configured to provide electrical components including one or more resistors; and, a second layer assembly positioned over the first layer assembly, the second layer assembly being primarily configured to form a filter and define fluid-feed passageways and firing chambers, wherein the second layer assembly comprises at least one layer which extends across the fluid supply conduit and is primarily configured to filter fluid and not primarily to form a firing chamber.

9. The fluid ejection device of claim 8, wherein the at least one layer of the second layer assembly has a thickness of no more than about 20 percent of a thickness of a layer which forms the firing chamber.

10. The fluid ejection device of claim 8, wherein the first layer assembly comprises multiple thin-film layers.

11. The fluid ejection device of claim 8, wherein the second layer assembly comprises a filter layer positioned adjacent the first layer assembly.

12. The fluid ejection device of claim 8, wherein the second layer assembly comprises at least three layers.

13. A fluid ejection device comprising:

a substrate having a first surface and a second surface, the substrate defining a fluid supply conduit between the first surface and the second surface; and, a generally elastic filter layer formed over the first surface, wherein the filter layer does not form sidewalls defining a fluid channel of the fluid ejection device.

14. The fluid ejection device of claim 13, wherein the fluid channel is configured to supply fluid to a firing chamber.

15. A fluid ejection device comprising:

a substrate defining a fluid supply conduit;

a generally elastic filter layer formed over the substrate in fluid receiving relation with the fluid supply conduit, the filter layer having a thickness; and, an additional layer formed over the filter layer and having a thickness, wherein multiple fluid channels are formed in the additional layer and wherein the thickness of the additional layer is at least four times the thickness of the filter layer.

16. The fluid ejection device of claim 15, wherein the generally elastic filter layer comprises a polymer.

17. A method comprising:

forming at least one thin film layer over a first surface of a substrate;

forming at least one generally planar elastic filter layer over the at least one thin film layer the generally planar elastic filter layer having at least one fluid filter opening formed therein; and, forming at least one further layer over the generally elastic layer to form sidewalls which define at least in part multiple firing chambers.

18. The method of claim 17 further comprising, after said acts of forming, forming a fluid supply conduit through the substrate between the first surface and a generally opposing second surface.

19. A method comprising:

forming a first layer assembly over a first surface of a substrate wherein the first layer assembly forms one or more electrical traces; and, forming a second layer assembly over the first layer assembly, wherein the first layer assembly comprises a first layer configured to filter contaminants from a fluid and not to form electrical traces, the first layer having at least one fluid filter opening formed therein over a fluid supply conduit of the substrate, and at least one additional layer formed over the first layer which forms at least a portion of sidewalls which define multiple firing channels.

20. The method of claim 19, wherein said forming a first layer of the second layer assembly comprises forming a first layer which enhances adhesion of the first layer assembly to the at least one additional layer of the second layer assembly.

21. A fluid ejection device comprising:

a substrate defining a fluid supply conduit;

a first layer assembly positioned over the substrate, the first layer assembly being primarily configured to provide electrical components including one or more resistors; and, a second layer assembly positioned over the first layer assembly, the second layer assembly being primarily configured to form a filter and define fluid-feed passageways and firing chambers, wherein the second layer assembly comprises at least one layer primarily configured to filter fluid and not primarily to form a firing chamber such that the at least one layer has a thickness of no more than about 20 percent of a thickness of a different layer which forms the firing chambers.

22. A fluid ejection device comprising:

a substrate defining a fluid supply conduit;

a first layer assembly comprising multiple thin-film layers and positioned over the substrate, the first layer assembly being primarily configured to provide electrical components including one or more resistors; and, a second layer assembly positioned over the first layer assembly, the second layer assembly being primarily configured to form a filter and define fluid-feed passageways and firing chambers, wherein the second layer assembly comprises at least one layer primarily configured to filter fluid and not primarily to form a firing chamber.

23. A fluid ejection device comprising:

a substrate defining a fluid supply conduit;

a first layer assembly positioned over the substrate, the first layer assembly being primarily configured to provide electrical components including one or more resistors; and, a second layer assembly comprising at least three layers and positioned over the first layer assembly, the second layer assembly being primarily configured to form a filter and define fluid-feed passageways and firing chambers, wherein the second layer assembly comprises at least one layer primarily configured to filter fluid and not primarily to form a firing chamber.

* * * * *